US006068182A

United States Patent [19]

Tokunaga

[11] Patent Number: 6,068,182

[45] Date of Patent: May 30, 2000

[54] INSULATED CONTAINER

[76] Inventor: Keiiti Tokunaga, 674, Mizuho-Cho, Moriyama-shi, Shiga, Japan, 524-0102

[21] Appl. No.: 09/355,372

[22] PCT Filed: Nov. 23, 1998

[86] PCT No.: PCT/JP98/05290

§ 371 Date: Jul. 26, 1999

§ 102(e) Date: Jul. 26, 1999

[87] PCT Pub. No.: WO99/28197

PCT Pub. Date: Jun. 10, 1999

[30] Foreign Application Priority Data

Nov. 27, 1997 [JP] Japan ..... 9-364268

[51] Int. Cl.[7] ..... B65D 3/22

[52] U.S. Cl. ..... 229/403; 220/738; 220/739

[58] Field of Search ..... 229/403; 220/737, 220/738, 739, 741, 903

[56] References Cited

U.S. PATENT DOCUMENTS

| | | | |
|---|---|---|---|
| 1,814,671 | 7/1931 | Dufour | 229/403 |
| 2,563,352 | 8/1951 | Morse | 229/403 |
| 2,661,889 | 12/1953 | Phinney | 220/903 |
| 2,832,493 | 4/1958 | Murphy | 220/903 |
| 5,469,983 | 11/1995 | Yawata | 220/739 |
| 5,669,553 | 9/1997 | Smith | 220/739 |
| 5,752,653 | 5/1998 | Razzaghi | 229/403 |
| 5,769,311 | 6/1998 | Morita et al. | 229/403 |

FOREIGN PATENT DOCUMENTS

| | | |
|---|---|---|
| 52-152043 | 11/1977 | Japan . |
| 4-45212 | 8/1990 | Japan . |
| 6-48474 | 12/1992 | Japan . |

*Primary Examiner*—Gary E. Elkins
*Attorney, Agent, or Firm*—Milde, Hoffberg & Macklin, LLP

[57] ABSTRACT

An insulated container of paper which does not feel hot to the touch even when a user holds a trunk portion thereof in a hot water-containing state. The trunk portion has a doubly-walled structure with an insulating space provided between two wall members thereof. The doubly-walled insulating space-retaining structure is formed, as shown in FIG. 2, by inwardly curling both end portions of a cylindrical member and firmly fitting the resultant cylindrical member around an outer surface of a trunk portion of an inner container body. This structure results in a container capable of being manufactured at a low cost and having a high insulating capability and a high grasping resistance.

7 Claims, 3 Drawing Sheets

INSULATED CONTAINER

FIELD OF THE INVENTION

The present invention relates to an insulated container particularly adapted to contain extremely hot water to make coffee, noodles, soup, and the like.

BACKGROUND OF THE INVENTION

Conventionally, a paper cup having a trunk portion of a triply-walled structure disclosed the published of Japanese Utility Model Application No. 52-152043, as shown in FIG. 6 therein has been known as an insulated container of this type.

The paper cup of a triply-walled structure can be attained by wrapping an embossed paper sheet 11 around an outer surface of an inner container body 8 as an intermediate wall 9, and then pasting a paper sheet printed and colored with indicia, logos, or other printed material to explain goods on the embossed paper 11 as an outermost surface 10 of the cup.

An space between the outer surface of the inner container body 8 and the outermost surface 10, which is produced due to the embossment of the intermediate wall 9, acts as an insulated layer.

However, since this paper cup is of a triply-walled structure as described above, much material and many process steps such as an embossing step and a pasting step are needed, thereby increasing the production cost. In terms of physical characteristics of paper, the height of the embossment 11 is only about 0.5 mm, at most, so that a large space between the outer surface of the inner container body 8 and the outermost surface 10 is not achieved. If the height of the embossment 11 is increased, the paper becomes unusable because paper fibers are torn off. In the case of the above-mentioned cup of a triply-walled structure, when the user holds the cup in an extremely hot water-containing state by hand, the cup does feel so hot. However, there is not insufficiently large insulating space between the outer surface of the inner container body 8 and the outermost surface 10, so that the insulating capability of the above-mentioned paper cup is not high enough. In addition to that, although much material is used to produce the cup, rigidity of the cup is not sufficiently high and its grasping resistance is low. Accordingly, it is a principal object of the present invention to provide an insulated container having a simple structure, a high insulating capability, and a high grasping resistance, which can be manufactured at a low cost.

SUMMARY OF THE INVENTION

This object, as well as other objects which will become apparent from the discussion that follows, is achieved, according to the present invention by inwardly curling both end portions of a cylindrical member and firmly fitting the resultant cylindrical member around an outer surface of a thin-walled inner container body having an opening and a bottom.

In the insulated container of the present invention, inwardly-curled upper and lower end portions of the cylindrical member are in direct contact with the outer surface of the thin-walled inner container body having an opening and a bottom. Accordingly, an air layer is formed between the outer surface of the thin-walled inner container body and the inner surface of the cylindrical member. Since this air layer acts as an insulating layer, heat transfer can be minimized. Moreover, inwardly-curled upper and lower end portions provide greater rigidity to the cylindrical member itself, and the firm-fitting of the cylindrical member around the outer surface of the inner container body increases the strength of the insulated container. As a result, a user does not feel the cup is hot even when the trunk portion is held and the cup is in an extremely hot water-containing state can consequently, the cup grasped it firmly without anxiety.

DESCRIPTION OF THE PREFERRED EMBODIMENTS

Figure 1:
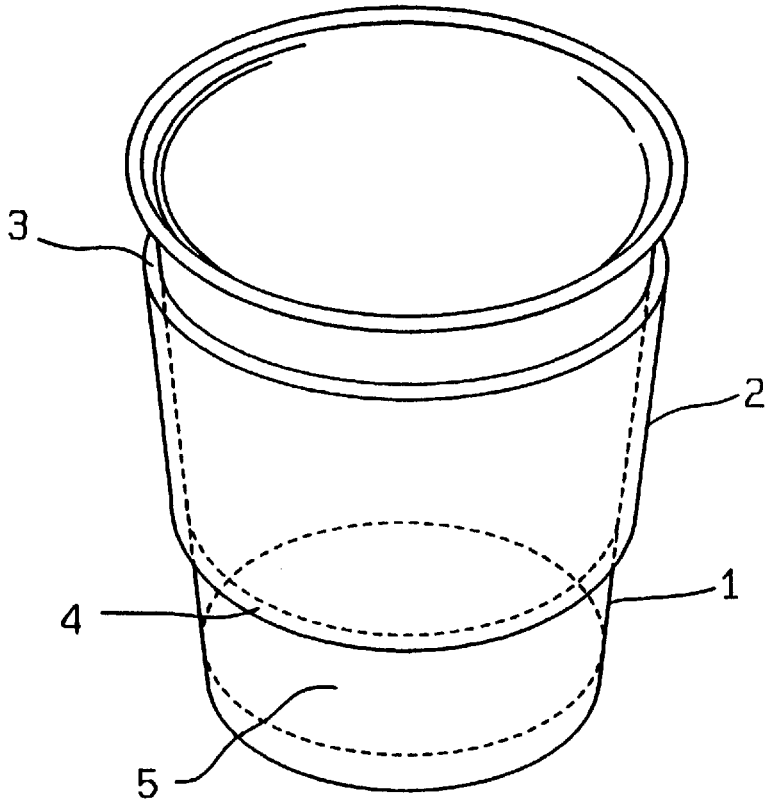
FIG. 1 is a perspective view of the insulated container of the present invention.
Figure 2:
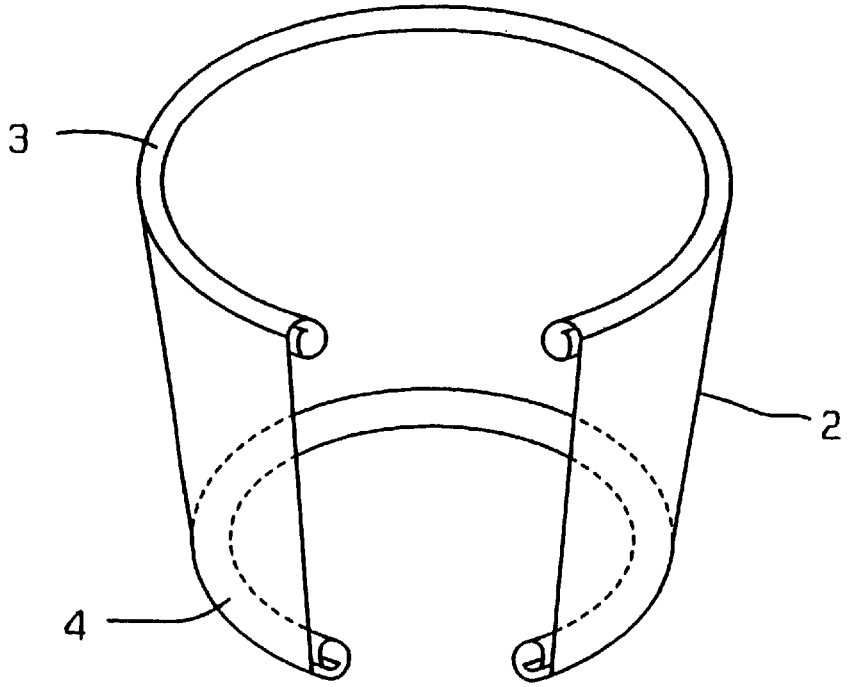
FIG. 2 is an exploded perspective view of the cylindrical member whose both end portions are inwardly curled.

The present invention will now be described in detail below with reference to the accompanying drawings. FIG. 1 shows an insulated container, in which a cylindrical member 2 having an inward top curl 3 and an inward bottom curl 4 formed on both end portions is firmly fitted around a paper cup 1 having a bottom. In this embodiment, the cylindrical member 2 is made of coated cardboard paper having a weight of 250 g per about 3.3 $m^2$, and the inward top curl 3 and the inward bottom curl 4 each have a thickness of 3 mm. Accordingly, there is 3 mm-distant space between the outer surface of the paper cup 1 and the inner surface of the cylindrical member 2, which exerts tremendous effect in heat insulation. Furthermore, the inward top curl 3 and the inward bottom curl 4 not only help keep a distance, but also provide greater rigidity to the cylindrical member itself, and the firm-fitting of the cylindrical member around the outer surface of the paper cup 1 provides greater rigidity to the insulated container. As a result, a user can stably hold the container even if he grasps it tightly.

Figure 3:
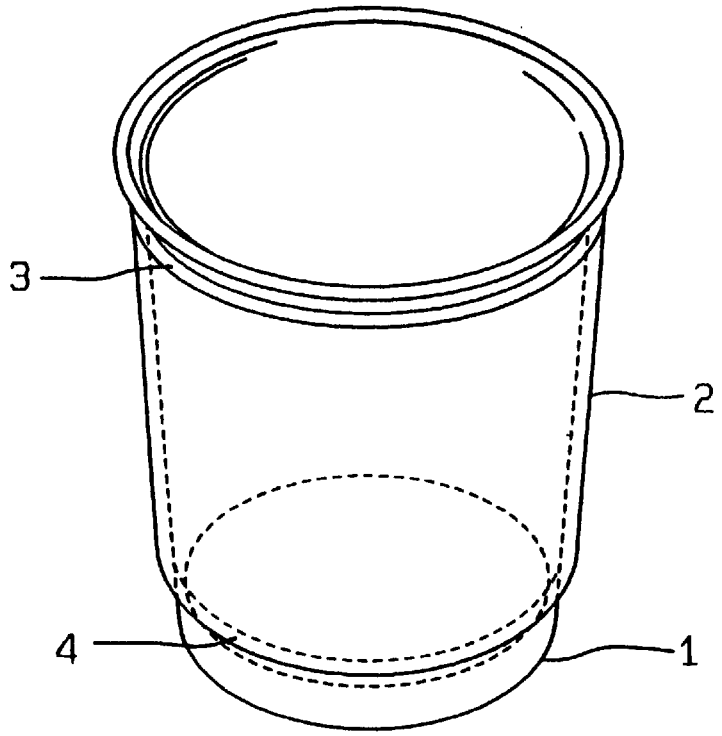
FIG. 3 is a perspective view of another embodiment of the insulated container of the present invention.

In this embodiment, the cylindrical member 2 is partly fitted around the middle of the height direction of the paper cup 1. However, as shown in FIG. 3, the cylindrical member 2 may cover a large part of the outer side surface of the paper cup 1, or the whole outer side surface of the paper cup 1, if necessary. In addition, the thicknesses of the inward curls can be arbitrarily set, and the thickness of the inward top curl can be different from that of the inward bottom curl.

Accordingly, the distance of the insulating space can be adjusted freely by controlling thicknesses or varying combinations of thicknesses of the inward top curl and the inward bottom curl.

Figure 4:
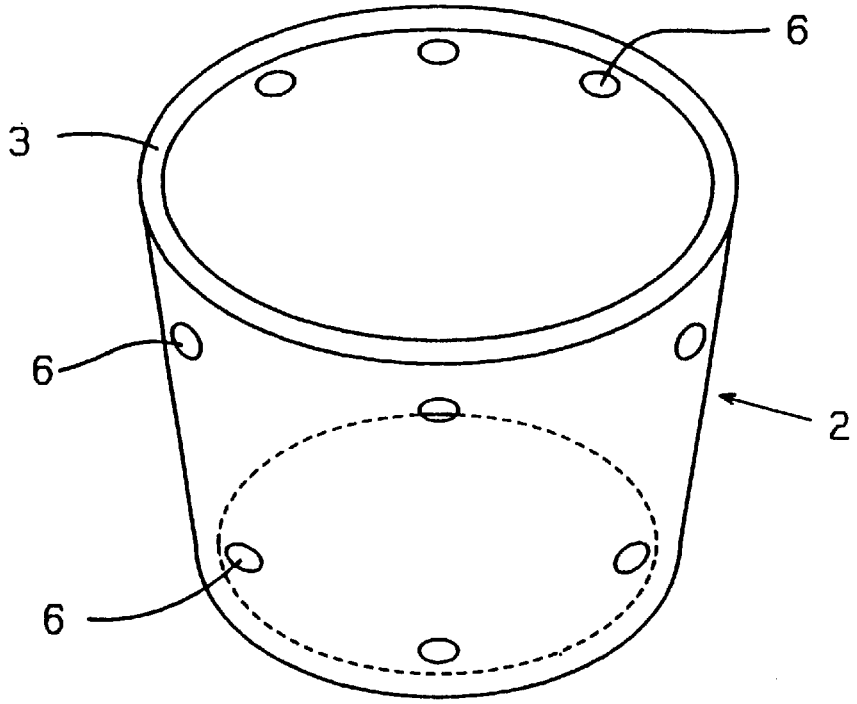
FIG. 4 is a perspective view of another embodiment of the cylindrical member of the present invention.

Further, the cylindrical member 2 can be variously designed. In addition to being variously printed and colored, the cylindrical member 2 may have a plurality of holes 6 on its arbitrary positions, as shown in FIG. 4. These holes can further enhance the insulating capability since the air in the space is let out and the fresh air is let in by heat convection.

Figure 5:
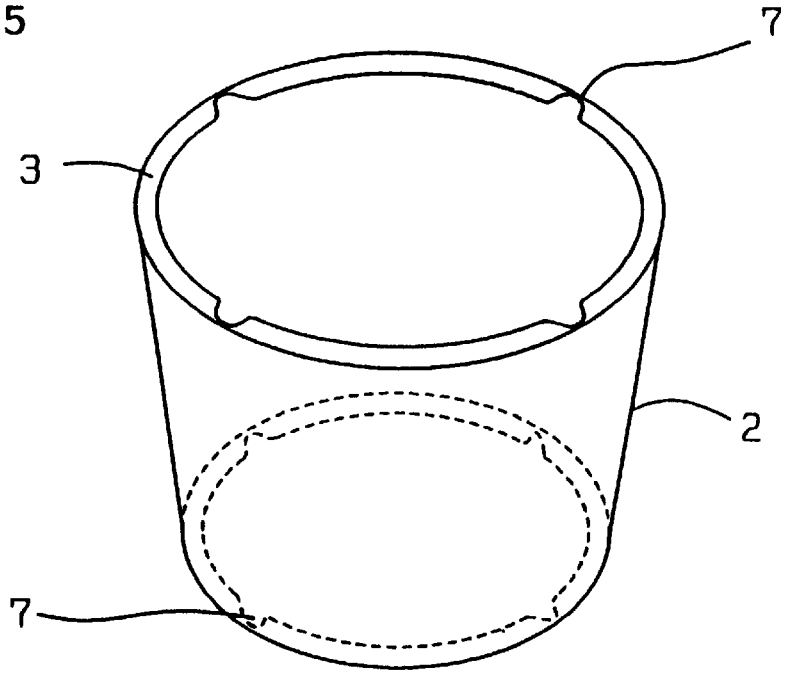
FIG. 5 is a perspective view of a further embodiment of the cylindrical member of the present invention.
Figure 6:
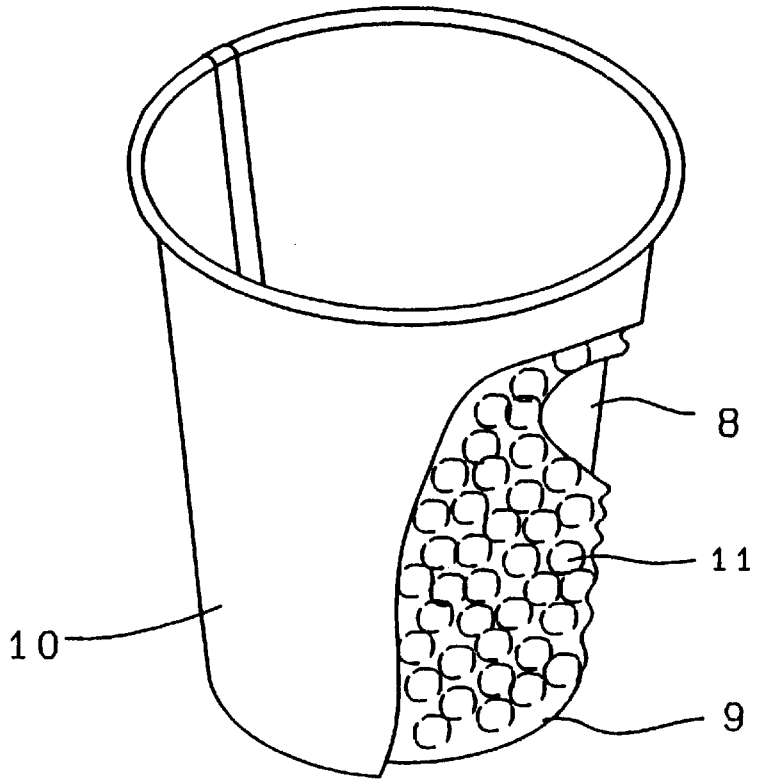
FIG. 6 is a perspective view of an embodiment of a conventional insulated container.

Alternatively, as shown in FIG. 5, the inward top curl and the inward bottom curl may have a plurality of crushed portions 7 or incisions. These crushed portions 7 or incisions can further enhance the insulating capability since the air in the space is let out and the fresh air is let in by heat convection, just as in the case of the above embodiment.

In a above embodiments, the cone-shaped container is used, however, a cylinder-shaped container, whose top and bottom have a same diameter, can also be used to yield the same effect.

INDUSTRIAL APPLICABILITY

As described above, the insulated container of the present invention has a simple structure, which enables the container capable of being manufactured at a low cost and having a high insulating capability and a great rigidity to be obtained. For this reason, the insulated container of the present invention is suitable for holding extremely hot water to make coffee, noodles, soup, and the like.

There has thus been shown and described a novel insulated container which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. An insulated container comprising:

a thin-walled inner container body having an upper rim providing an open top, a trunk portion, and a closed bottom; and a cylindrical member comprising an upper end portion and a lower end portion, both end portions being inwardly curled, wherein said cylindrical member is firmly fitted around an outer surface of the trunk portion of said inner container body.

2. The insulated container according to claim 1, wherein the thickness of the upper end portion of said cylindrical member is different from that of the lower end portion.

3. The insulated container according to claim 1, wherein said cylindrical member has a plurality of holes.

4. The insulated container according to claim 1, wherein the inwardly curved upper end portion of said cylindrical member has a plurality of crushed portions or incisions.

5. The insulated container according to claim 1, wherein the inwardly curved lower end portion of said cylindrical member has a plurality of crushed portions or incisions.

6. The insulated container according to claim 1, wherein said thin-walled container is of circular cone shape.

7. The insulated container according to claim 1, wherein said thin-walled container is cylindrical in shape.

* * * * *